US006052102A

United States Patent [19]

Abe

[11] Patent Number: 6,052,102

[45] Date of Patent: Apr. 18, 2000

[54] PLASMA ADDRESSED ELECTRO-OPTICAL DISPLAY

[75] Inventor: Hironobu Abe, Kanagawa, Japan

[73] Assignee: Sony Corporation, Tokyo, Japan

[21] Appl. No.: 08/986,360

[22] Filed: Dec. 8, 1997

[30] Foreign Application Priority Data

Dec. 9, 1996 [JP] Japan ..... 8-328950

[51] Int. Cl.[7] ..... G09G 3/36; G09G 3/28

[52] U.S. Cl. ..... 345/87; 345/60

[58] Field of Search ..... 345/60–63, 98–100, 345/80, 87

[56] References Cited

U.S. PATENT DOCUMENTS

| | | | |
|---|---|---|---|
| 5,696,569 | 12/1997 | Bongaerts et al. | 345/60 |
| 5,786,794 | 7/1998 | Kishi et al. | 345/60 |
| 5,909,199 | 6/1999 | Miyazaki et al. | 345/60 |

*Primary Examiner*—Richard A. Hjerpe
*Assistant Examiner*—Benjamin D. Bowers
*Attorney, Agent, or Firm*—Hill & Simpson

[57] ABSTRACT

A plasma addressed electro-optical display including a first substrate having a plurality of discharge electrodes formed thereon; a dielectric layer disposed apart from the first substrate for a predetermined distance; a plasma cell formed by sealing the peripheries of the first substrate and the dielectric layer with a sealing portion; and a second substrate disposed opposite to the dielectric layer and having signal electrodes intersecting the discharge electrodes on the surface thereof, wherein the plasma cell and the second substrate are stacked in such a manner that an electro-optical material layer is interposed between the plasma cell and the second substrate so that the plasma addressed electro-optical display is formed, discharge channels are formed each of which is formed by at least two adjacent discharge electrodes, a scanning circuit for supplying selection pulses to the discharge channels by a line-sequential scanning method is provided, signal circuit for applying an image signal to each of the signal electrodes in synchronization with the line-sequential scanning operation is provided, and discharge drive stages of the discharge channels are formed by complementary circuits.

8 Claims, 6 Drawing Sheets

PLASMA ADDRESSED ELECTRO-OPTICAL DISPLAY

BACKGROUND OF THE INVENTION

1. Field of the Invention

The present invention relates to an image display having a liquid crystal cell which is operated by line-sequential scanning of discharge channels, that is, relates to a so-called plasma addressed electro-optical display.

2. Description of Prior Art

The resolution and contrast of a liquid-crystal type display unit have been improved by, for example, a so-called active matrix addressing method, in which an active device, such as a transistor, is provided for each display pixel and the active devices are operated.

The foregoing method, however, must use a multiplicity of semiconductor devices, such as thin-film transistors, thus causing a problem of unsatisfactory low manufacturing yield to arise when a display having a large area is manufactured. Therefore, there arises a problem in that the cost cannot be reduced.

To solve the foregoing problem, a method has been suggested which employs discharge plasma as active devices in place of the semiconductor devices, such as MOS transistors and thin-film transistors.

An image display apparatus (hereinafter called a "plasma addressed electro-optical display") arranged to operate liquid crystal by using discharge plasma has a stacked structure composed of a liquid crystal material layer, which is an electro-optical material layer, and a plasma cell, in which plasma discharge takes place. A thin dielectric-material plate made of glass or the like is disposed between the liquid crystal layer and the plasma cell.

The plasma addressed electro-optical display has a structure in which the plasma cell is divided into linear plasma chambers by barrier ribs. The plasma chambers are sequentially switched and scanned, and signal voltages are synchronously applied to transparent electrodes opposite to the plasma chambers that is positioned so that the liquid crystal layer is interposed. Thus, the liquid crystal layer is operated.

The plasma addressed electro-optical display has a multiplicity of pairs of cathode electrodes and anode electrode placed in a line to serve as discharge channels for performing a lateral scan. FIG. 1 shows the foregoing state, in which anode electrodes 102 and cathode electrodes 103 are alternately disposed in a region surrounded by a frit seal 101. Each pair of the anode electrode 102 and the cathode electrode 103 forms one discharge channel.

In the above-mentioned structure, discharge is required to take place between the anode electrode 102 and the cathode electrode 103 in one pair. However, the cathode electrodes 103 in adjacent channels sometimes undesirably perform a discharge.

FIG. 2 is an enlarged view of a portion in which the cathode electrodes 103 extend beyond the anodes 102 and the barrier ribs 104. If regions in each of which a barrier rib 104 for separating the channels from each other is not formed exist, the adjacent cathode electrodes 103 perform an undesirable discharge in the region having no barrier rib 104 for separating the channels from each other.

The foregoing discharge is unnecessary for the operation of the panel and damages the devices for operating the cathode electrodes 103. The unnecessary discharge sometimes causes heat damage to the electrodes in the panel and failure of the drive devices.

OBJECT AND SUMMARY OF THE INVENTION

In view of the foregoing, an object of the present invention is to provide a reliable plasma addressed electro-optical display with which unnecessary discharge does not take place and failure of the panel and drive devices can be prevented.

To achieve the above-mentioned and other objects, according to one aspect of the present invention, there is provided a plasma addressed electro-optical display including a first substrate having a plurality of discharge electrodes formed thereon; a dielectric layer disposed apart from the first substrate by a predetermined distance; a plasma cell formed by sealing the peripheries of the first substrate and the dielectric layer with a sealing portion; and a second substrate disposed opposite to the dielectric layer and having signal electrodes on the surface thereof which intersect the discharge electrodes, wherein the plasma cell and the second substrate are stacked in such a manner that an electro-optical material layer is interposed between the plasma cell and the second substrate so that the plasma addressed electro-optical display is formed, discharge channels are formed each of which includes at least two adjacent discharge electrodes, a scanning circuit for supplying selection pulses to the discharge channels by a line-sequential scanning method is provided, a signal circuit for applying an image signal to each of the signal electrodes in synchronization with the line-sequential scanning operation is provided, and discharge drive stages of the discharge channels are formed by complementary circuits.

The plasma addressed electro-optical display according to the present invention may have a structure that each of the complementary circuits has a first switch device group and a second switch device group to which a high-voltage power source is connected.

The plasma addressed electro-optical display according to the present invention may have a structure that a resistor is inserted into the portion of the discharge drive stage adjacent to the high-voltage power source.

The plasma addressed electro-optical display according to the present invention may have a structure that the first switch device group and the second switch group perform contrary operations.

The plasma addressed electro-optical display according to the present invention may have a structure that each of the discharge electrodes is composed of an anode electrode and a cathode electrode, and the cathode electrode is connected to the high-voltage power source through a low-level resistor.

The plasma addressed electro-optical display according to the present invention may have a structure that a diode is inserted into a forward direction following the resistor.

When a plasma addressed electro-optical display as shown in FIG. 3 is to be driven by a plasma discharge high voltage power source 3 with a connection of a drive circuit board 2 to the cathode electrode of a display panel 1, it is conventional that a protection resistor 4 is inserted in a discharge route, so as to prevent abnormal discharge between the cathode electrode and the anode electrode.

However, when viewed from the drive circuit board 2, there exists a floating capacitance Cf which is connected by a dotted line in the figure. This is caused by a drive stage control power source or the like.

The current loop L of this capacitance Cf cannot be restricted by a constant current circuit 5 or by the protection resistor 4 for the anode electrode.

According to the present invention, a resistor 6 is inserted at the input to the drive circuit board 2, thus restricting this current loop L, suppressing abnormal discharge between the cathode electrodes.

It should be noted that in a complementary type circuit using a switch element having a large terminal-to-terminal capacitance, the total capacitance of lines of the display panel 1 becomes significantly large and charges accumulated there cannot be ignored.

In such a case, the total capacitance can be suppressed by inserting a diode having a small bonding capacitance to a high voltage power supply side of the switch element or the group of switch elements.

Other objects, features and advantages of the invention will be evident from the following detailed description of the preferred embodiments described in conjunction with the attached drawings.

DETAILED DESCRIPTION OF THE INVENTION

An embodiment of the present invention will now be described with reference to the drawings.

Figure 4:
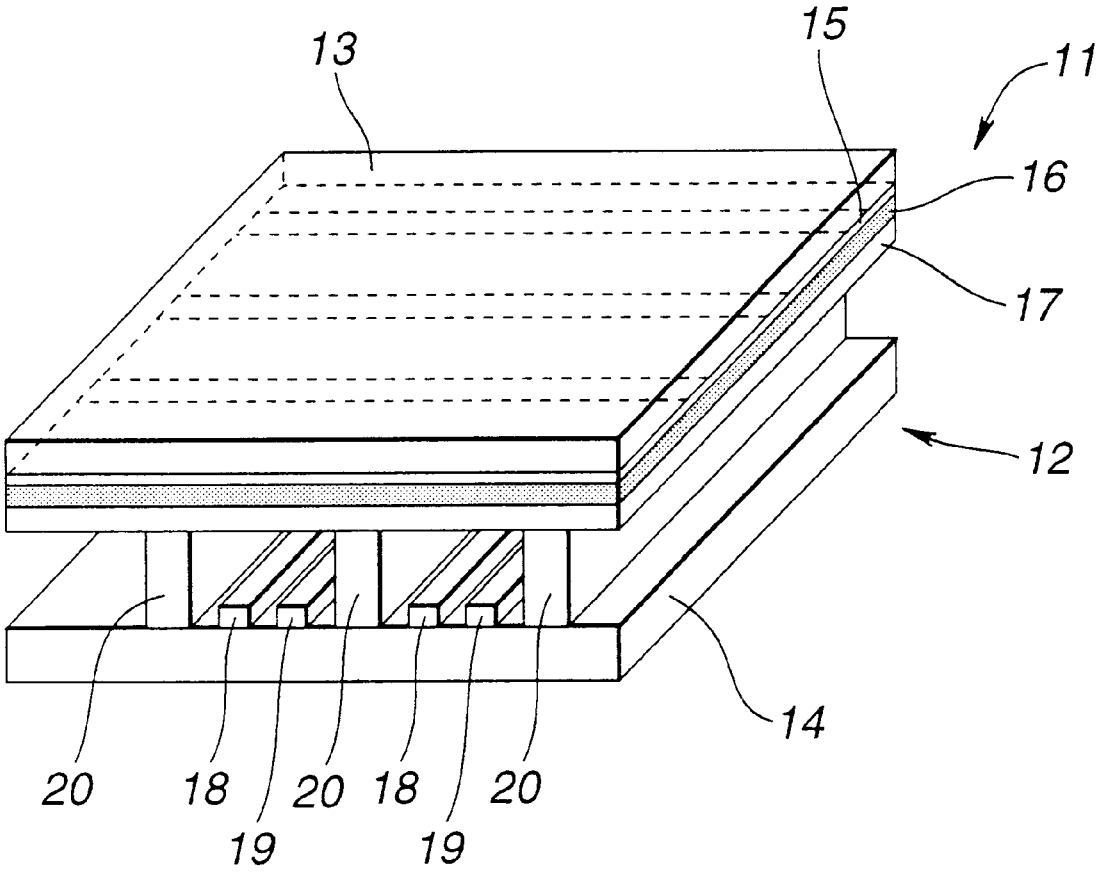
FIG. 4 is an enlarged schematic and perspective view showing a portion of the structure of a plasma addressed electro-optical display according to the present invention.

FIG. 4 is a perspective view showing the structure of a portion of an embodiment of a plasma addressed electro-optical display according to the present invention.

The plasma addressed electro-optical display is composed of a liquid crystal cell 11 and a plasma cell 12.

The plasma cell 12 has a structure that includes discharge electrodes which are anode electrodes 18 and cathode electrodes 19 that are alternately disposed on a glass substrate 14 so that discharge channels are formed.

The liquid crystal cell 11 has transparent electrodes 15 formed into stripe configuration arranged in, for example, the vertical direction of the frame on a substrate 13. A liquid crystal layer 16 is formed below the transparent electrodes 15. A dielectric sheet 17 made of a thin glass plate is placed on the surface of the liquid crystal layer 16 which is joined to the plasma substrate 12.

The liquid crystal cell 11 and the plasma cell 12 are joined to each other by barrier ribs 20 in such a manner that a predetermined distance is maintained between the liquid crystal cell 11 and the plasma cell 12.

Figure 1:
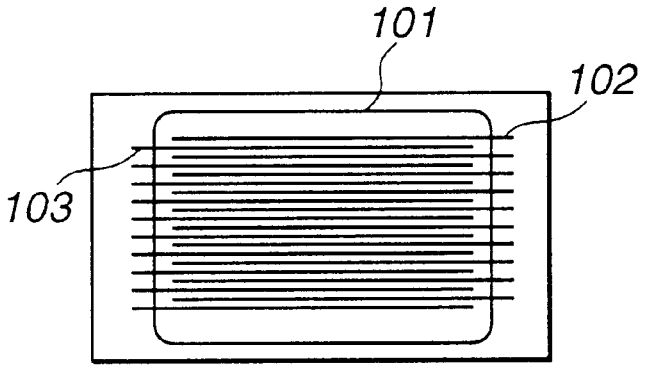
FIG. 1 is a schematic plan view showing the configuration of electrodes in a plasma addressed electro-optical display.
Figure 2:
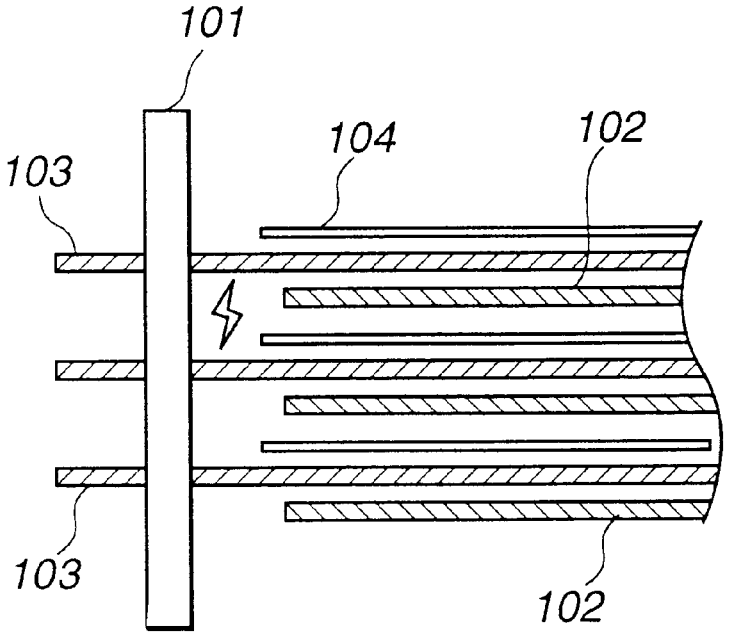
FIG. 2 is an enlarged schematic plan view showing an essential portion of a section in which the cathode electrodes extend beyond the anodes and the barrier ribs.
Figure 3:
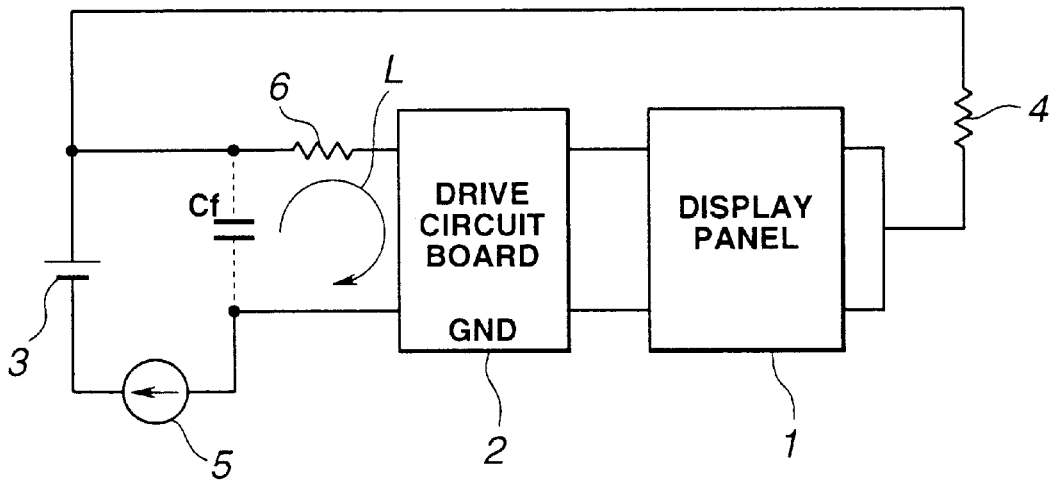
FIG. 3 is a schematic circuit diagram showing the basic structure of the present invention.
Figure 5:
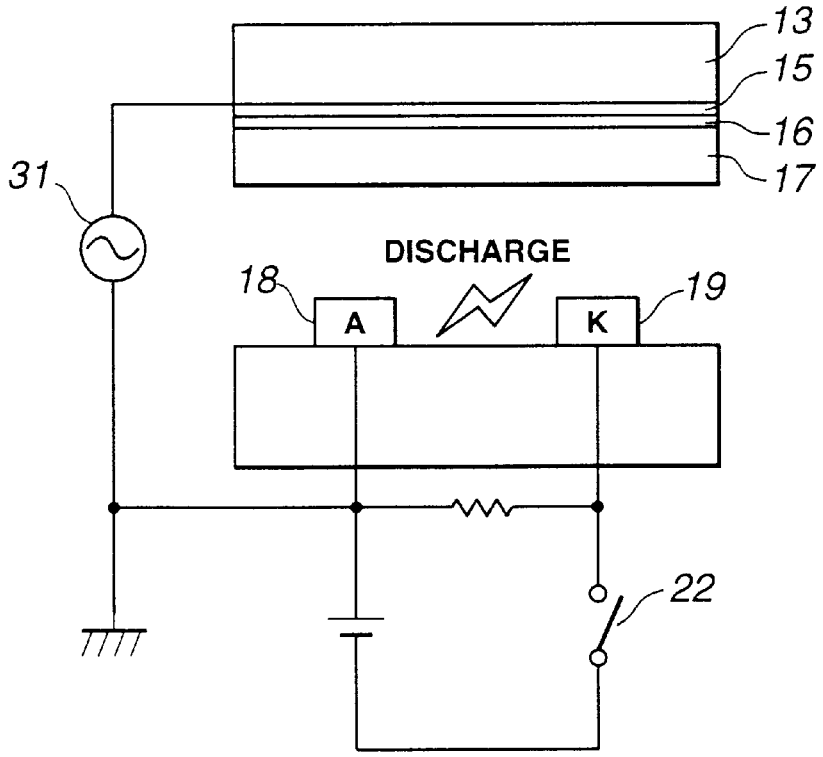
FIG. 5 is a schematic view showing a circuit in the plasma addressed electro-optical display according to the present invention.

FIG. 5 is a diagram showing one pair of the anode electrode 18 and the cathode electrode 19 forming one lateral line and a circuit including the foregoing pair.

The basic structure of the plasma addressed electro-optical display will now be described. The plasma addressed electro-optical display uses discharge selection pulses to open/close a switch 22 to apply a voltage to cause a discharge to take place between the anode electrode 18 and the cathode electrode 19. Electrical charges appear below the dielectric sheet 17 during the discharge or immediately after the discharge has taken place which write a voltage from a voltage source that appears between the anode electrodes 18 and the transparent electrodes 15 on the liquid crystal layer 16.

A drive circuit for operating the cathode electrodes 19 is generally composed of switch devices including transistors or a FET. The drive circuit switches on the switch device to lower the potential of the corresponding cathode electrode 19 to cause a discharge to take place.

When the time for the discharge ends, the switch device is opened (switched off) to return the cathode potential to an anode potential.

Figure 6:
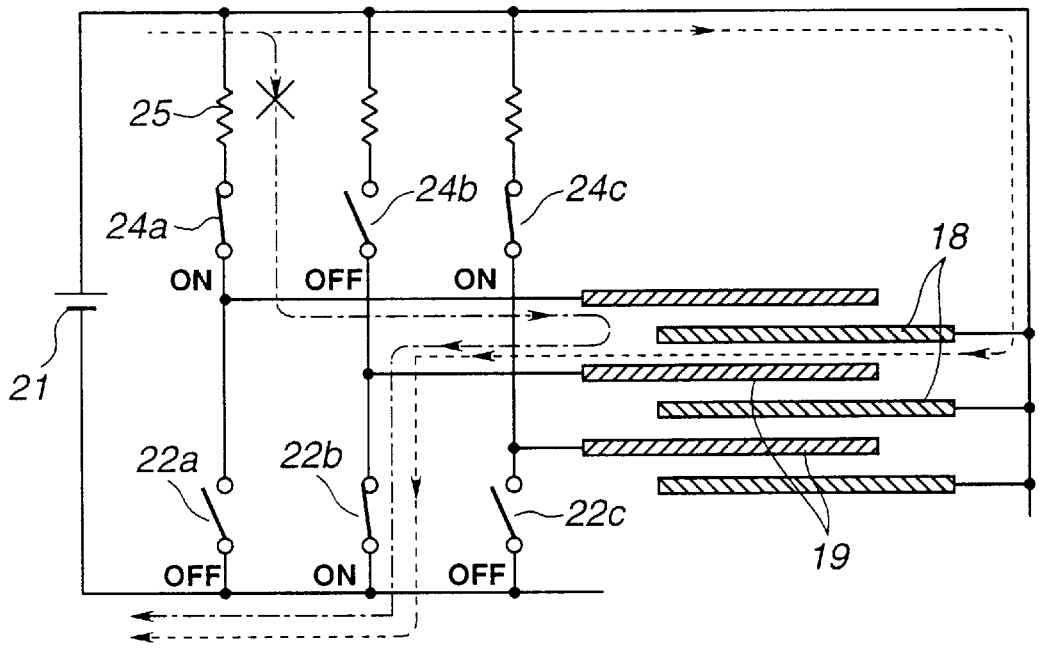
FIG. 6 is a circuit diagram showing an example of a complementary-type drive circuit according to the present invention.

FIG. 6 is a circuit diagram showing a complementary-type drive circuit.

The stage for operating the cathode electrodes 19 is composed of switch device groups 22*a*, 22*b*, 22*c*, . . . , and switch device groups 24*a*, 24*b*, 24*c*, . . . to which a high-voltage power source 21 for the plasma discharge is connected.

The complementary-type drive circuit is arranged in such a manner that the switch device groups 22*a*, 22*b*, 22*c*, . . . , and the switch device groups 24*a*, 24*b*, 24*c*, . . . , perform contrary operations. Thus, the cathode electrodes 19 are always connected to a positive or negative side of the high-voltage power source 21 for the plasma discharge through considerably low-level resistances (the on-resistance of the switch device).

For example, when the switch device 22*b* is switched on, the switch device 24*b* is switched off. At this time, the other switch devices 22*a*, 22*c*, . . . , are switched off and the switch devices 24*a*, 24*c*, . . . , are switched on.

All of the cathode electrodes 19 of the channels except for the channels which have been turned on have the same potentials as those of the anode electrodes 18. Thus, an abnormal discharge sometimes takes place between the cathode electrodes 19, as described above. At this time, a current pathway, which is different from a normal discharge current pathway, is formed as indicated with an alternate long and short dash line, the current pathway being formed to pass through, for example, the switch device 24*a*.

Note that the electric current is not substantially limited in the above-mentioned pathway as shown in FIG. 6.

Thus, there is a fear that a large current which is nearly a short-circuit current flows in the switch device 22*b* and the switch device 24, which has been switched on, which results in damage from unwanted discharges in the display panel due to; and to damage to the switch devices 22*b* and 24*a*.

It might be considered feasible to employ a countermeasure against the above-mentioned undesirable discharge in which the cathode electrodes 19 at the portion in which the unwanted discharge takes place are covered with insulation members. The foregoing countermeasure is insufficient to perfectly prevent the unnecessary discharge. Since an AC-like discharge takes place through the insulation members, the circuit must have means to prevent the unwanted discharge.

Therefore, resistors 25 serving as current limiting devices are inserted into the unwanted current pathway to shut down the electric current which causes the abnormal discharge to take place.

In this embodiment, the resistors 25 are inserted into the switch device groups 24*a*, 24*b*, 24*c*, . . . , in series.

It is preferable that each of the resistors 25 has a maximum resistance value so as to shut down the electric current. Although an infinite resistance value is ideal to shut down the electric current, the potentials of the cathode electrodes 19 become instable when the switch device groups 22*a*, 22*b*, 22*c*, . . . , have been switched off. Thus, the resistors 25 are employed which have a maximum resistance values with which the plasma addressed electro-optical display is able to perform a normal operation.

Since the resistors 25 are provided on the discharge drive stages adjacent to the portions for receiving high-voltage electric power, failure of the display panel and the drive devices (the switch devices) attributable to unnecessary abnormal discharges and the electric currents can be prevented.

Figure 7:
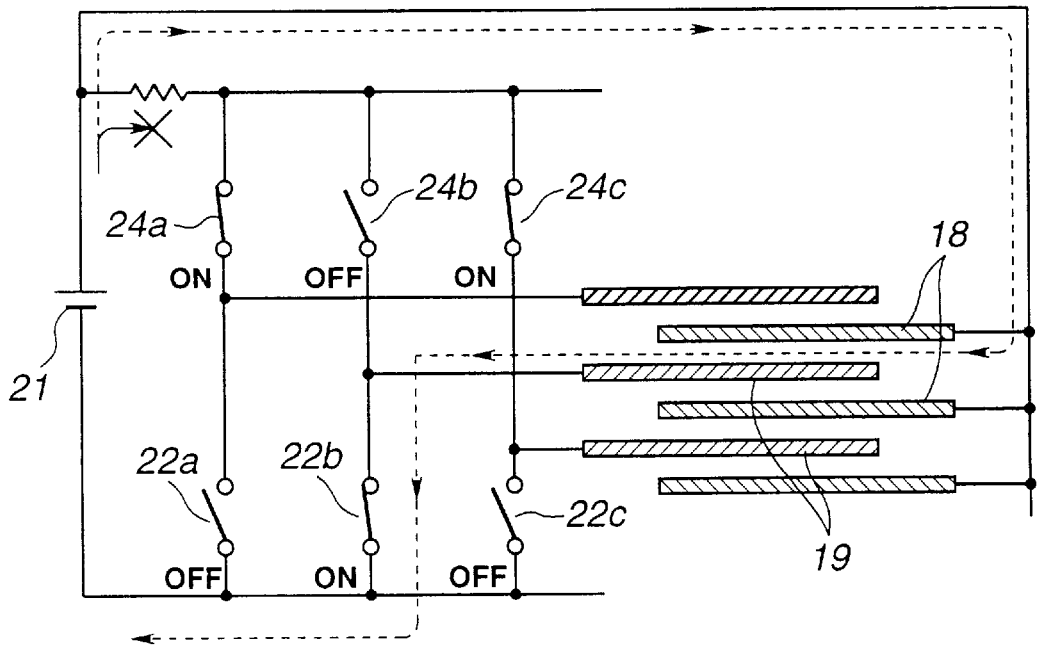
FIG. 7 is a circuit diagram showing another example of the complementary-type drive circuit according to the present invention.

FIG. 7 shows an example of a structure in which resistors to be inserted are collected into one resistor. One resistor 26 is inserted into the portion of the complementary-type drive stage for receiving the high-voltage electric power. The resistor 26 attains an effect similar to that obtainable from the resistors 25.

If the circuit structure shown in FIG. 7 is employed, the arrangement using the switch device groups 22*a*, 22*b*, 22*c*, . . . and 24*a*, 24*b*, 24*c*, . . . , each having a large capacities between their terminals, results in the total capacitance corresponding to all lines of the display panel being enlarged considerably. Thus, electrical charges which are accumulated in the capacitance cannot be ignored.

Figure 8B:
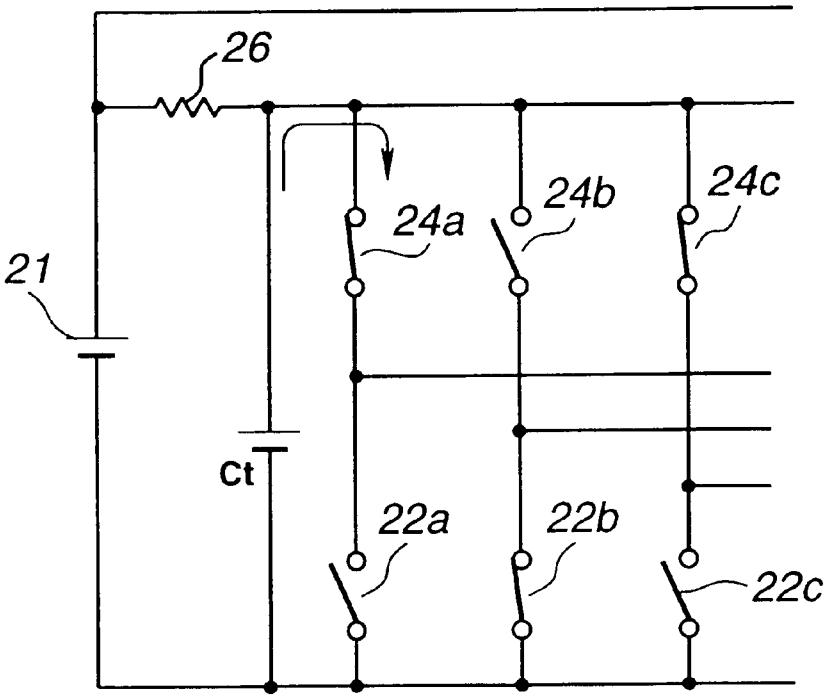
FIGS. 8A and 8B are circuit diagrams showing a floating capacitance which increases unwanted electrode discharges.
Figure 8A:
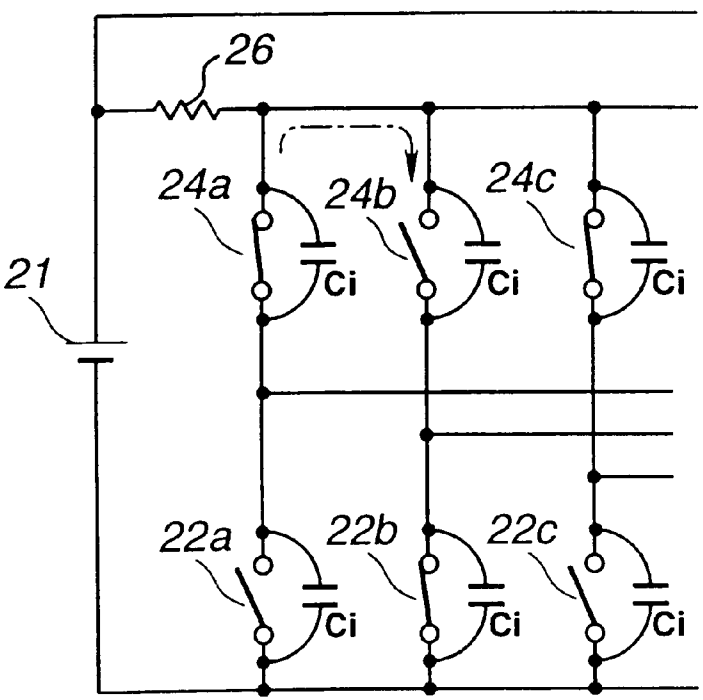

Capacitance Ci, as shown in FIG. 8A, results from the switch device groups 22*a*, 22*b*, 22*c*, . . . , and switch device groups 24*a*, 24*b*, 24*c*, . . . , the capacitance Ci causing an effect which is similar to a large capacitor Ct being connected following the inserted resistor 26, as shown in FIG. 8B.

If an unwanted discharge takes place between the cathode electrodes 19, the electrical charges accumulated in the capacity Ci, as a matter of course, do not pass through the resistor 26. Te electrical charges are introduced into the cathode electrodes 19 which have been turned on, thus causing the unwanted discharge to be greater. The foregoing problem also arises if the switch groups are formed by IC devices. The foregoing problem cannot be prevented by only the resistor 26.

Figure 9:
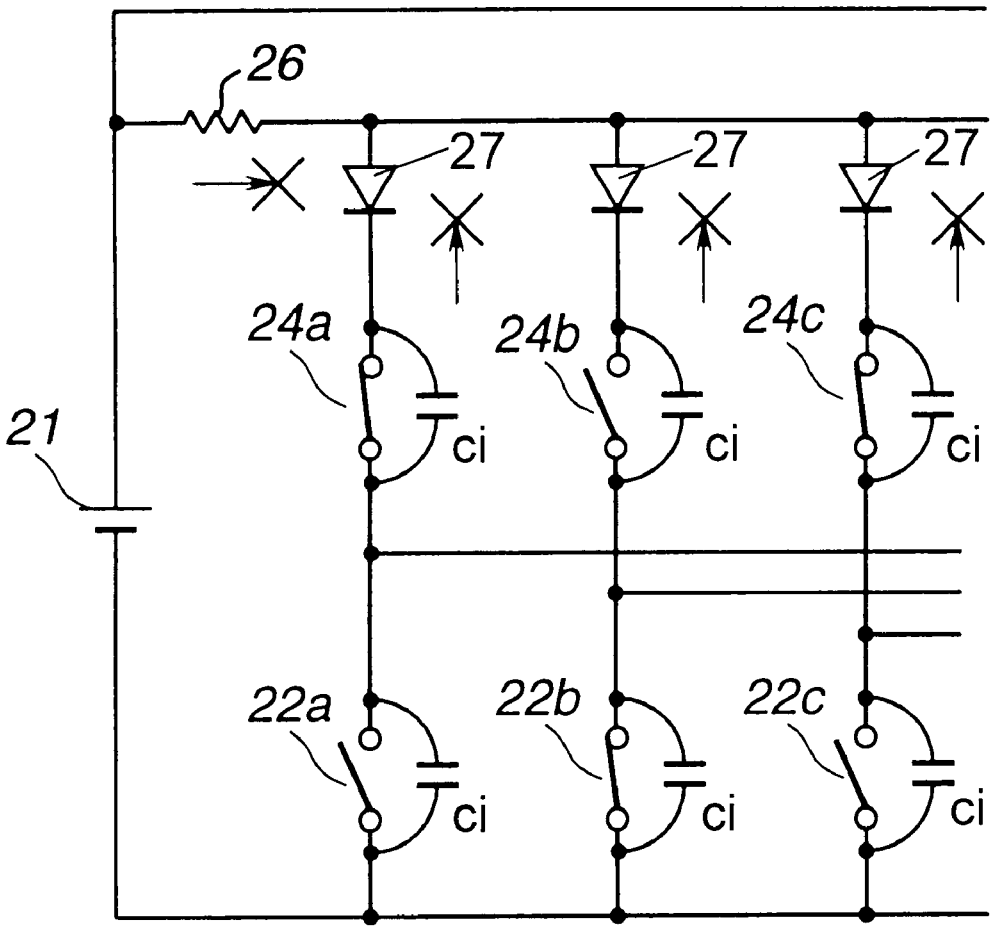
FIG. 9 is a circuit diagram showing another example of the complementary-type drive circuit according to the present invention.

Accordingly, diodes 27 each having a small coupled capacitance, in the forward direction, are inserted into the supply port of the switch device groups 24*a*, 24*b*, 24*c*, . . . for receiving the high-voltage electric power, as shown in FIG. 9.

As a result, the above-mentioned capacitance Ci and the coupled capacitance of the diodes 27 are connected in series so that the total capacitance is reduced.

Since each of the diodes 27 is inserted into the circuit in a direction in which introduction of the other coupled capacitance is prevented, only the current pathway through the resistor 26 is formed when an unwanted discharge takes place. Thus, prevention of unwanted discharges is accomplished.

As described above, according to the present invention, a reliable plasma addressed electro-optical display can be provided with which an unwanted discharge does not take place and failure of the panel and drive devices can be prevented.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A plasma addressed electro-optical display, comprising:

a first substrate having a plurality of discharge electrodes formed thereon;

a dielectric layer disposed spaced apart from said first substrate by a predetermined distance;

a plasma cell formed by sealing peripheries of said first substrate and said dielectric layer with a sealing portion; and a second substrate disposed opposite to said dielectric layer and having signal electrodes intersecting said discharge electrodes, said signal electrodes being formed on a surface of said second substrate;

an electro-optical material between said plasma cell and said second substrate in such a manner that said plasma addressed electro-optical display is formed;

discharge channels each of which includes at least two adjacent discharge electrodes;

a scanning circuit for supplying selection pulses to said discharge electrodes by a line-sequential scanning method;

a signal circuit for applying an image signal to each of said signal electrodes in synchronization with the line-sequential scanning operation;

discharge drive stages for said discharge channels including complementary switches;

a discharge voltage source connected to supply a discharge voltage to said discharge electrodes through said discharge drive stages; and a discharge suppressing element connected between said discharge voltage source and said complementary switches.

2. A plasma addressed electro-optical display according to claim 1, wherein said discharge voltage source is a high-voltage power source, and wherein each of said complementary switches has a first switch device and a second switch device to which said high-voltage power source is connected, said discharge suppressing element being connected between said second switch device and said high voltage power source, said high voltage power source being a voltage sufficient to cause a discharge between the discharge electrodes.

3. A plasma addressed electro-optical display according to claim 2, wherein said discharge suppressing element is a resistor connected at an input of said discharge drive stage adjacent to the high-voltage power source.

4. A plasma addressed electro-optical display according to claim 3, wherein the first switch device and said second switch perform contrary operations.

5. A plasma addressed electro-optical display according to claim 3, wherein each of said discharge electrodes is composed of an anode electrode and a cathode electrode, and said cathode electrode is connected to said high-voltage power source through discharge suppressing element.

6. A plasma addressed electro-optical display according to claim 3, wherein said discharge suppressing element further includes a diode connected in a forward direction following said resistor.

7. A plasma addressed electro-optical display as claimed in claim 3, wherein said complementary switches are a plurality of parallel switch circuits; and said resistor of said discharge suppressing element comprises a plurality of resistors, each connected in series with a corresponding one of said switch circuits.

8. A plasma addressed electro-optical display as claimed in claim 3, wherein said complementary switches are a plurality of parallel switch circuits; and said resistor of said discharge suppressing element is a single resistor connected at an input of said parallel switch circuits.

* * * * *